US007731447B1

(12) United States Patent
Dunwoody

(10) Patent No.: US 7,731,447 B1
(45) Date of Patent: Jun. 8, 2010

(54) RACING FACILITY PIT SYSTEM

(76) Inventor: Harold J. Dunwoody, 27271 Trefoil St., Murrieta, CA (US) 92562

( * ) Notice: Subject to any disclaimer, the term of this patent is extended or adjusted under 35 U.S.C. 154(b) by 0 days.

(21) Appl. No.: 12/346,660

(22) Filed: Dec. 30, 2008

Related U.S. Application Data

(60) Provisional application No. 61/009,560, filed on Dec. 31, 2007, provisional application No. 61/137,080, filed on Jul. 28, 2008.

(51) Int. Cl.
*E01C 1/00* (2006.01)
*E01C 11/22* (2006.01)
*A63K 1/00* (2006.01)
*E01F 9/00* (2006.01)

(52) U.S. Cl. ..... 404/1; 404/6; 472/85; 52/174

(58) Field of Classification Search ..... D25/16; 52/220.7, 33, 174; 404/1, 6; 472/85, 89, 472/92, 94
See application file for complete search history.

(56) References Cited

U.S. PATENT DOCUMENTS 3,391,620 A * 7/1968 Mahoney ..... 404/6
3,774,723 A * 11/1973 Johnston ..... 186/36
3,777,774 A * 12/1973 Martin ..... 137/234.6
4,004,857 A * 1/1977 Eschen, Jr. ..... 404/6
4,161,850 A * 7/1979 Peterson et al. ..... 52/65
5,081,803 A 1/1992 Jackson
5,241,796 A * 9/1993 Hellwig et al. ..... 52/36.4
5,645,368 A * 7/1997 Yunick ..... 404/6
5,875,597 A * 3/1999 Gingrich et al. ..... 52/239
5,896,710 A * 4/1999 Hoyle ..... 52/144
6,095,522 A * 8/2000 Spell et al. ..... 273/246
D433,030 S * 10/2000 Taylor et al. ..... D15/9.2
6,834,856 B2 * 12/2004 Wilson ..... 273/246
7,185,460 B2 * 3/2007 Corden ..... 52/36.5
7,470,166 B2 * 12/2008 Allen ..... 446/108
2004/0187399 A1 * 9/2004 Andree ..... 52/79.1
2006/0180367 A1 * 8/2006 Hudak ..... 180/69.4
2008/0268968 A1 * 10/2008 Back ..... 472/85

* cited by examiner

*Primary Examiner*—Thomas B Will
*Assistant Examiner*—Abigail A Risic
(74) *Attorney, Agent, or Firm*—Knobbe Martens Olson & Bear, LLP

(57) ABSTRACT

A racing facility with a racing surface and a pit road. The pit road includes an pit road entrance connected to the racing surface, a plurality of pit walls defining a plurality of elongate pit boxes/stops each connected at a first end thereof to the pit road entrance, wherein the pit boxes are arranged in a side by side configuration and are arranged at an angle with respect to the pit road entrance and wherein the pit walls are movable such that a given pit box can be defined on a left side or a right side of a respective pit wall. The pit road also includes a pit road exit connected to the pit boxes at opposite second ends thereof wherein at least a portion of the pit road exit is arranged substantially parallel to at least a portion of the pit road entrance. The pit road entrance and/or pit road exit can intersect the racing surfaces at acute angles. The pit boxes can intersect one or both of the entrance and pit road exits at acute angles. Pit wall supports can be permanent or portable and can include resilient impact absorbing surfaces. Fixed designators indicate assigned pit boxes.

13 Claims, 8 Drawing Sheets

RACING FACILITY PIT SYSTEM

CROSS-REFERENCE TO RELATED APPLICATIONS

This application claims the benefits of U.S. provisional applications 61/009,560 filed Dec. 31, 2007 and 61/137,080 filed Jul. 28, 2008 which are both incorporated herein in their entirety by reference.

BACKGROUND OF THE INVENTION

1. Field of the Invention

The invention relates to the field of racing and to a pit road configured to provide improved safety and access.

2. Description of the Related Art

A variety of racetrack configurations are utilized for a wide variety of racing events. Racetracks can include closed loop configurations such as circle tracks or ovals and closed loop road race courses. Racetracks can also include substantially straight, non-closed configurations, such as drag strips. Racetracks can be stand alone dedicated facilities not generally open to normal road traffic. However, racetracks can also be formed in part or wholly of roads normally open to traffic, however which may be temporarily closed to normal traffic for a racing event. Racetracks can be paved and can also be formed in part or wholly of improved or unimproved natural surfaces, such as dirt, sand, gravel, and/or turf.

Many disciplines of racing extend over a sufficient length of time that racing vehicles may require service during the race, for example for refueling and/or replacement of tires or other parts. Even sprint type races that do not normally require in-race servicing can include provisions for such in-race services. For example, if a race director calls a wet race, a racer can change to a different vehicle fitted with opposite wet vs. race slick tires based on changing weather conditions.

As time/distance is typically the determinant in determining race winners, it is desired that any in-race servicing be performed as rapidly as possible. Accordingly, pit roads are generally provided close to or adjacent a normal racing path of the vehicles. To obtain in-race servicing, a racer would typically exit the normal racing path or lane and enter a pit to obtain needed services.

The typical configuration for a pit road is to have the race vehicles enter the pit generally in a nose to tail arrangement, stop to obtain the desired services, and continue in a generally straight path to rejoin the racing circuit. As racing events tend to be highly competitive and subject to fairly strict rules and limits, it is frequently the case that numerous racers will briefly pull out of the race or "pit" to obtain needed services at the same time. This frequently results in a number of vehicles entering and leaving the pit concurrently. While safety regulations generally require that the racers slow from racing speeds upon entering a pit, the racers nevertheless tend to approach the pit road at relatively high rates of speed. The racers are also frequently required to accelerate to a relatively high rate of speed upon leaving a pit in order to rejoin the racing traffic.

Pit roads are generally populated with a number of personnel other than the racers. For example, pit crews are often present to assist the racers with needed services. A number of medical personnel, safety personnel, officials, media, and the like are also frequently present in a pit. The entrance and exit of race vehicles in close proximity to pedestrian traffic and other vehicle traffic, such as pace cars, ambulances, fire equipment, and the like present numerous possibilities for collision and injury. While numerous safety regulations and/or facilities improvements are frequently made to reduce the risk of such accidents, pit road collisions remain a significant concern. Thus, it will be appreciated that there exists an ongoing need for improvements in-race servicing to improve safety for both the racers and other personnel present at a race facility while maintaining an exciting and competitive race experience.

SUMMARY OF THE INVENTION

Embodiments include a racing facility with a racing surface and a pit road including an pit road entrance connected to the racing surface, a plurality of pit walls defining a plurality of elongate pit boxes each connected at a first end thereof to the pit road entrance, wherein the pit boxes are arranged in a side by side configuration and are arranged at an angle with respect to the pit road entrance and wherein the pit walls are movable such that a given pit box can be defined on a left side or a right side of a respective pit wall, and an pit road exit connected to the pit boxes at opposite second ends thereof and wherein at least a portion of the pit road exit is arranged substantially parallel to at least a portion of the pit road entrance.

Other embodiments include a pit road for a racing facility with an pit road entrance configured to intersect a racing surface of a racing facility, an pit road exit configured to intersect the racing surface of the racing facility and wherein at least a portion of the pit road exit is substantially parallel to at least a portion of the pit road entrance, and a plurality of movable pit walls arranged between the entrance and the pit road exits so as to define a plurality of elongate pit boxes extending between the entrance and pit road exits wherein the plurality of pit boxes are arranged in a side by side configuration and wherein the plurality of pit boxes are substantially parallel to each other.

Additional embodiments include a movable pit wall assembly with a first pit wall support, an opposed second pit wall support, and a movable pit wall engaged with the first and the second pit wall supports such that the pit wall is movable in a transverse manner between a leftmost position and a rightmost position. These and other objects and advantages of the invention will become more apparent from the following description taken in conjunction with the accompanying drawings.

DETAILED DESCRIPTION OF THE PREFERRED EMBODIMENT

Reference will now be made to the drawings where like reference designators refer to like components or structures throughout. It should be understood that the illustrations are schematic in nature and should not be interpreted as being to scale or number for any particular implementation.

Figure 1:
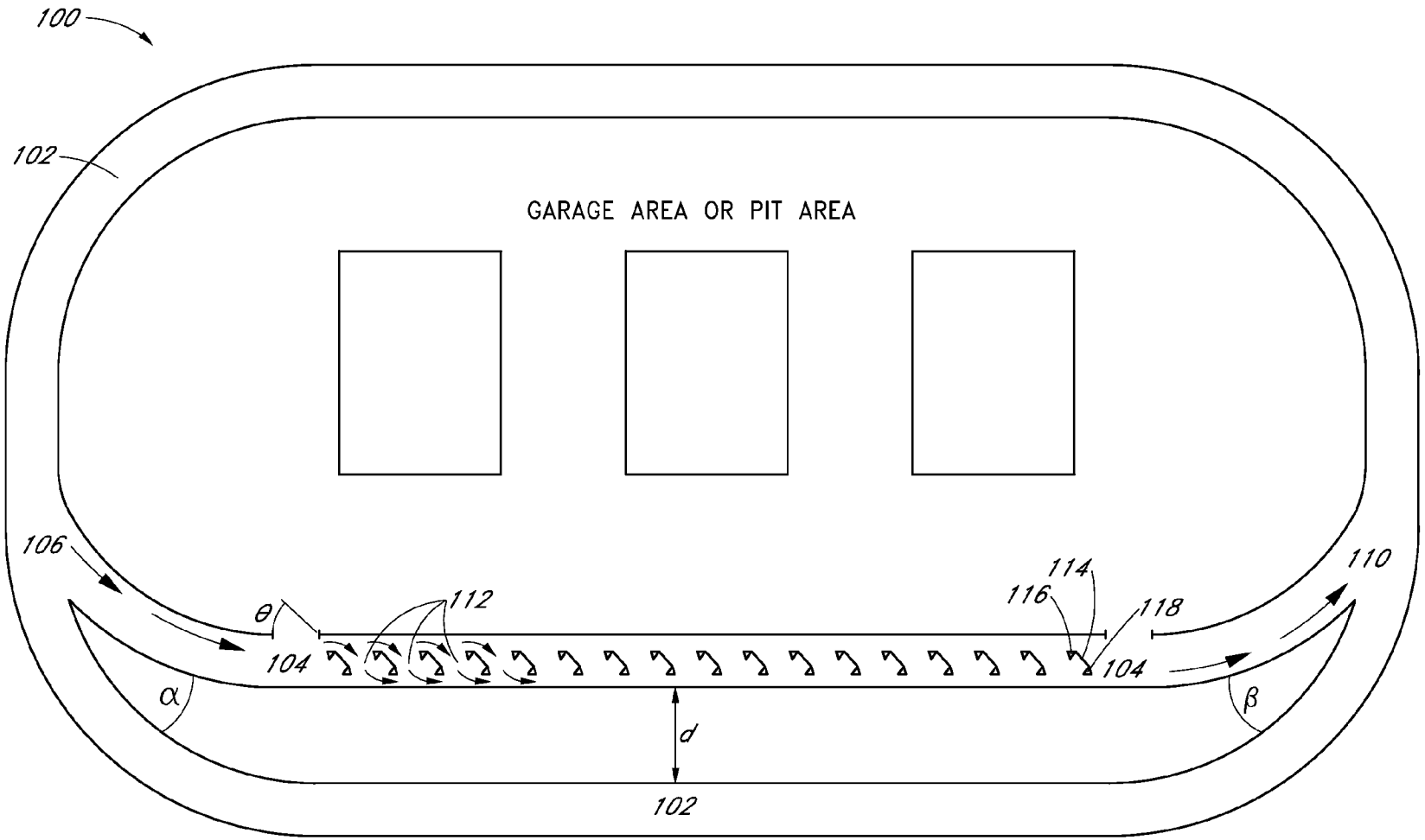
FIG. 1 is a schematic plan view of one embodiment of a racetrack and pit road with a counterclockwise direction of travel.

FIG. 1 illustrates schematically a plan view of an embodiment of a racetrack 100 including a racing surface 102 and a pit road 104. While the racing surface 102 is illustrated generally as an oval, this is simply for ease of understanding and a variety of other embodiments of racing surface 102 are possible. For example, in other embodiments, the racing surface 102 can comprise a closed loop road course having multiple curvatures, including opposed curvatures. The racing surface 102 can be paved or unpaved and can include a portion or in full roadways which may otherwise be used for normal vehicle traffic. It will also be understood that while reference will be made to a racing surface 102 there will generally be room for multiple vehicles to travel in a side-by-side manner about the racing surface 102.

The pit road 104 is connected to the racing surface 102 by a pit road entrance 106 and a pit road exit 110. Racers wishing to utilize the pit road 104 can exit the racing surface 102 via the pit road entrance 106 to enter the pit road 104. Upon completion of in-race servicing, vehicles can exit the pit road 104 via the pit road exit 110 and rejoin the racing surface 102. In some embodiments, one or both of the pit road entrance 106 and the pit road exit 110 intersect the racing surface 102 at acute angles $\alpha$, $\beta$. In some embodiments, one or both of the pit road entrance 106 and the pit road exit 110 intersect the racing surface 102 at angles $\alpha$, $\beta$ of less than approximately 45°. Where present, acute intersections between one or both of the pit road entrance 106 and the pit road exit 110 and the racing surface 102 provide a smoother transition for racers entering/exiting the pit road 104 and improve visibility between racers on the racing surface 102 and those entering/leaving the pit road 104 thereby improving safety.

In one embodiment, at least portions of the pit road entrance 106 and pit road exit 110 are parallel to each other. For example, a terminal end of the pit road entrance 106 can be substantially parallel to an entrance end of the pit road exit 110. In some embodiments, at least portions of the pit road entrance 106 and the pit road exit 110 are substantially collinear. In some embodiments, at least portions of the pit road entrance 106, the pit road exit 110, and or the pit road 104 are substantially parallel to adjacent portions of the racing surface 102.

The pit road 104 comprises a plurality of pit boxes or stops 112. The pit boxes (stops) 112 are generally elongate regions that can comprise a paved or unpaved surface. Individual pit boxes 112 are arranged generally in a side-by-side configuration and in some embodiments extend generally parallel to each other. In some embodiments, the pit boxes 112 are arranged at an angle $\theta$ with respect to one or more of the pit road entrance 106, the pit road exit 110, and an adjacent portion of the racing surface 102. For example, in some embodiments the pit boxes 112 are arranged at an acute angle of approximately 35 to 60 degrees with respect to an adjacent generally straight portion of the racing surface 102. Where present, acute intersections between one or both of the pit road entrance 106 and the pit road exit 110 and the pit boxes 112 also provide a smoother transition for racers entering/exiting the pit road 104 and improve visibility between racers and any other vehicles or pedestrian traffic in the pit road 104 thereby improving safety.

The pit boxes 112 are defined in part by a plurality of moveable pit walls 114. The moveable pit walls 114 serve as partitions to define individual pit boxes 112 and also as physical structural barriers for protection. For example, the moveable pit walls 114 can serve as a barrier to inhibit collisions between race vehicles entering or exiting the pit boxes 112 as well as to inhibit undesired contact between pedestrian or other vehicle traffic and the race vehicles.

In one embodiment, the moveable pit walls 114 are supported on opposite ends thereof by a respective first pit wall support 116 and an opposed second pit wall support 118. The moveable pit walls 114 are moveable in a generally transverse manner with respect to the first and second pit wall supports 116, 118. Embodiments of the moveable pit wall 114 provide the feature that the moveable pit walls 114 can be moved such that an associated pit box 112 is defined on a left side or on a right side of a respective associated moveable pit wall 114. This aspect provides additional flexibility in configuration of the pit road 104 to best suit a particular racing venue and/or class of racing.

Figure 2:
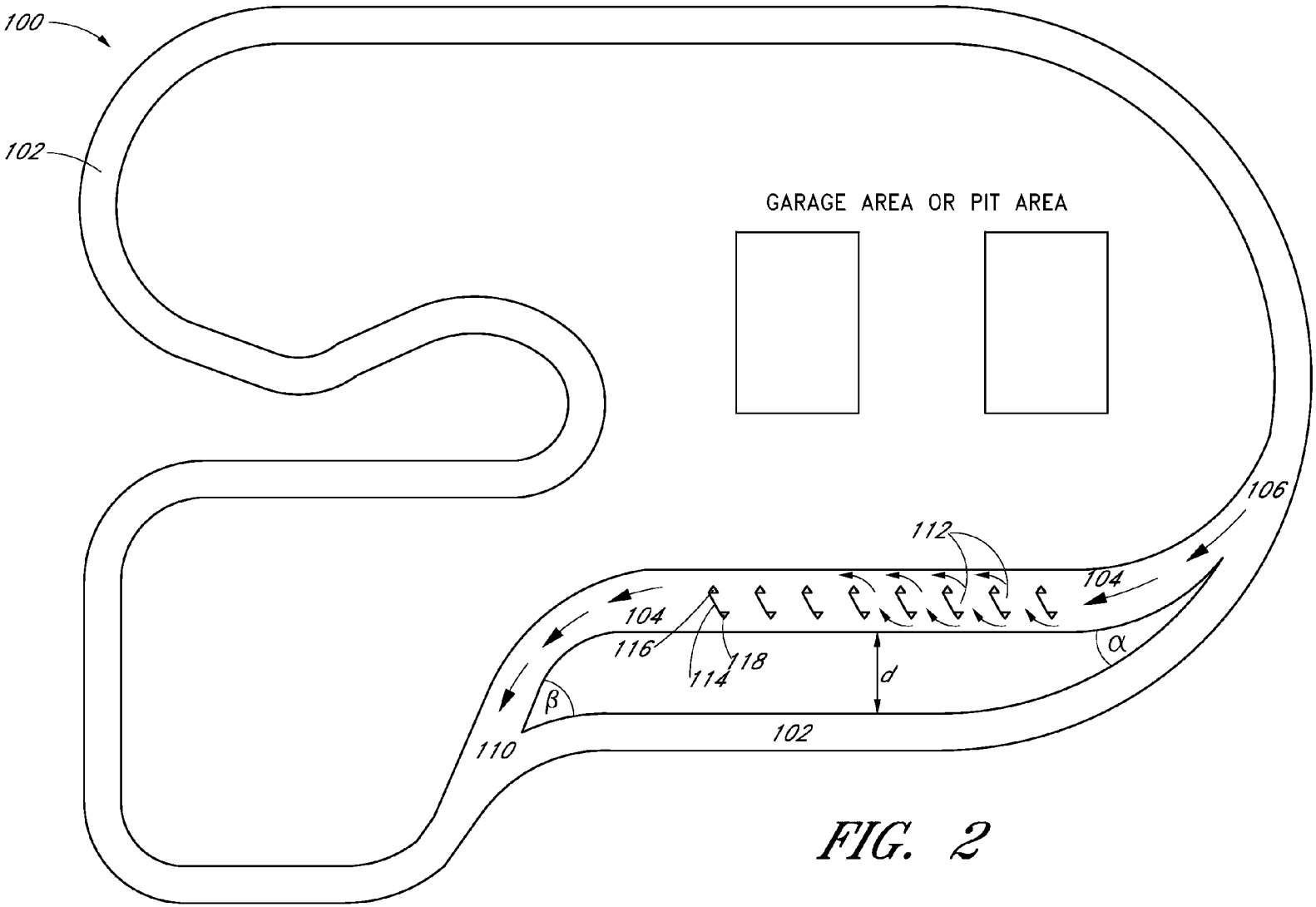
FIG. 2 is a schematic plan view of another embodiment of a racetrack and pit road with a clockwise direction of travel.

FIG. 2 illustrates a further embodiment of a racetrack 100 including a racing surface 102 and a pit road 104. The embodiment illustrated in FIG. 2 is at least partially similar to the embodiment illustrated with respect to FIG. 1 and similarities will not be repeated for brevity and ease of understanding. The embodiment of FIG. 2 illustrates a clockwise direction of travel whereas FIG. 1 illustrates a counterclockwise direction of travel. FIG. 1 also depicts a different configuration of racing surface 102 than that of FIG. 2. In the embodiment illustrated in FIG. 1, racers enter their respective pit box 112 from a location arranged more inwardly or away from the racing surface 102 and travel outwardly towards the racing surface 102 to enter their pit box 112 and exit the pit road 104. In the embodiment illustrated in FIG. 2, the racers enter their pit box 112 from a more outwardly arranged position and travel inwardly or towards the infield to enter their pit box 112 and exit the pit road 104.

Figure 3:
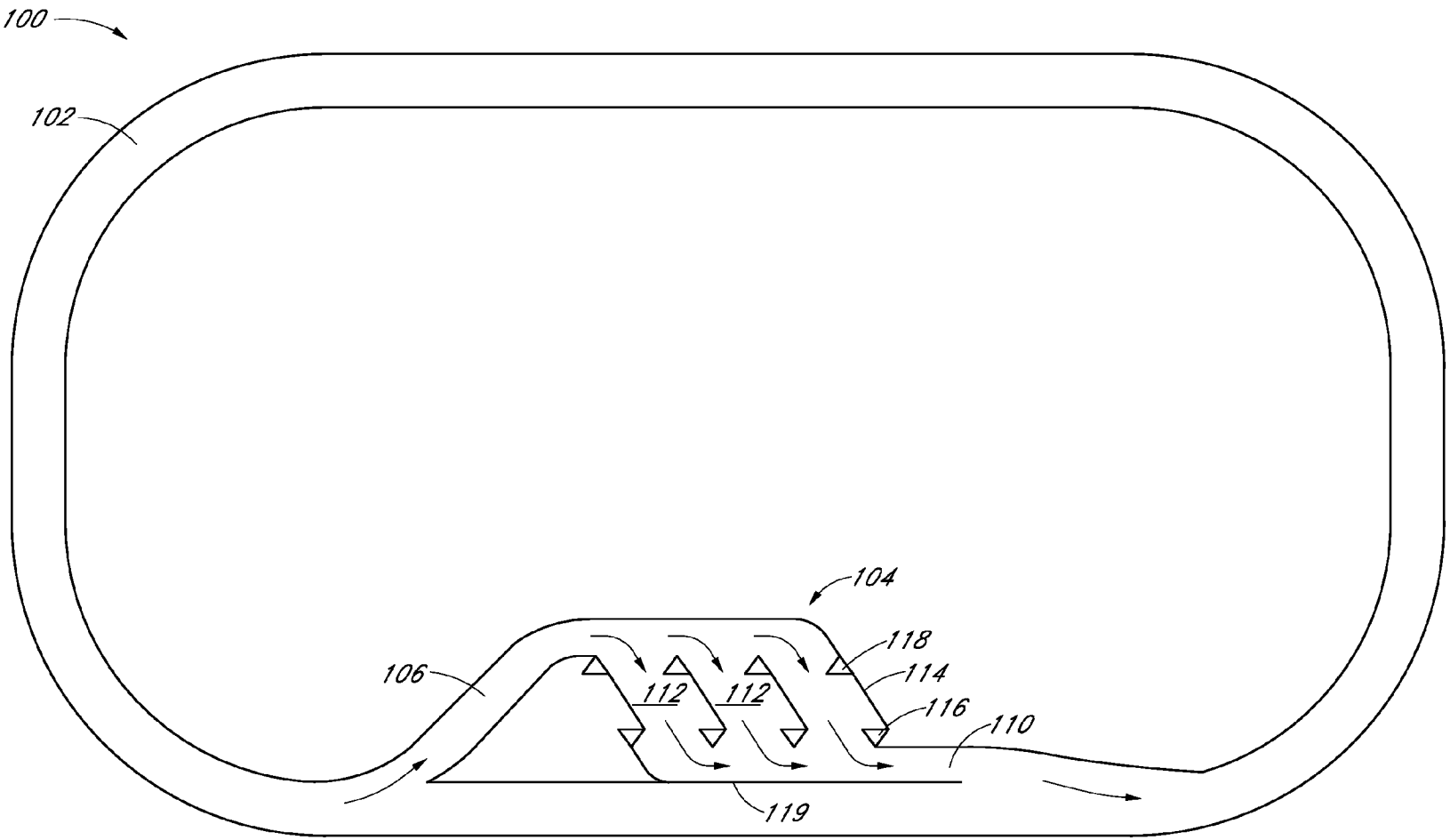
FIG. 3 is a schematic plan view of a further embodiment of a racetrack and pit road.

FIG. 3 illustrates a further embodiment of racetrack 100 including a racing surface 102 and a pit road 104. The embodiment illustrated in FIG. 3 also shares certain similarities with the embodiments previously illustrated and described with respect to FIGS. 1 and 2 and the similarities will not be repeated for brevity and ease of understanding. In the embodiments illustrated in FIGS. 1 and 2, the pit road 104 is separated or distanced from the racing surface 102 by a distance d. In the embodiment illustrated in FIG. 3, the pit road 104 is substantially adjacent the racing surface 102 and separated therefrom by a partition wall 119.

While the embodiments illustrated in FIGS. 1, 2, and 3 illustrate the pit road 104 arranged in an interior or infield of a generally closed loop racing surface 102, it will be understood that these are simply some embodiments and other arrangements are possible. For example, in other embodiments, the pit road 104 can be arranged at an exterior of a generally closed racing surface 102, e.g. opposite or outside the infield of the racetrack 100. In yet other embodiments, for example where a racing surface 102 is not a closed loop but for example extends generally as a straight line segment as in a drag strip, the pit road 104 can be arranged to either side of the racing surface 102 and/or at either end of the racing surface 102.

As can be seen in FIGS. 1, 2, and 3, the pit road 104 is separated from the racing surface 102. The pit road 104 defines a separate protected area where racers can obtain needed services for themselves and/or for their race vehicle. These services can include but are not limited to medical attention, refueling, tire changes, refreshment, wind screen cleaning, equipment changes, and the like. As the pit road 104 is separated from the racing surface 102, the pit road 104 can be considered to define an island pit. Additional advantages and features of the pit road 104 will be described and illustrated in greater detail below.

Figure 4:
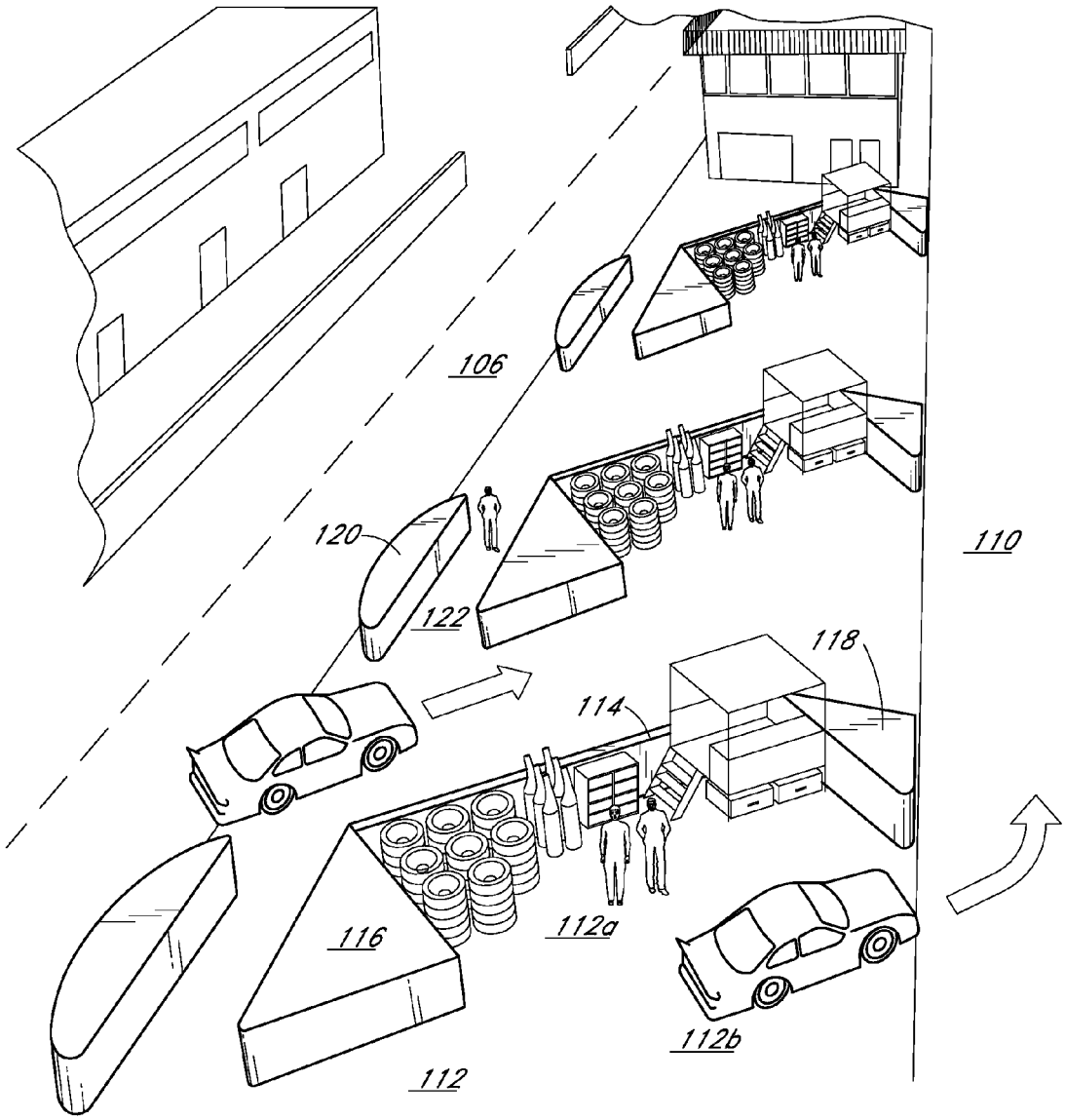
FIG. 4 is a perspective view of an embodiment of pit road in use.

FIG. 4 illustrates a schematic perspective view of embodiments of a pit road 104 during a racing event. As can be seen, vehicles can enter (in this embodiment from the viewer's left) from the pit road entrance 106. The vehicles can enter the pit box 112 for needed services. The pit box 112 comprises an area within the pit road 104 that is designated for use by a particular racer and any support personnel.

In some embodiments, a pit box 112 comprises a crew area 112*a* and a service area 112*b*. In this embodiment, the moveable pit wall 114 is arranged to the left in the racer's perspective such that the crew area 112*a* is arranged to the left of the service area 112*b*. Pit crews, other personnel, fuel, spare tires, tools, and other equipment can be stored for use in the crew area 112*a* until needed by the racer. As the racer enters the pit box 112, service personnel can approach with needed equipment/supplies from the left in this embodiment and perform required services for the racer and vehicle.

As can be seen in FIG. 4, the combination of the first and second pit wall supports 116, 118 and the moveable pit wall 114 provide protective barriers between the pit crew personnel and other race attendees and the racers as well as between the racers themselves. As racers enter from the pit road entrance 106 and exit via the pit road exit 110, physical barriers are in place as provided by the pit road 104 to inhibit collisions between race vehicles and between race vehicles and any pedestrian or other vehicle traffic in the pit road 104.

FIG. 4 also illustrates that some embodiments include a plurality of safety barriers 120 arranged to define a safety lane 122. The safety barriers 120 and safety lane 122 provide a protected avenue for movement, for example between adjacent pit boxes 112. For example, media personnel may wish to move from one pit box 112 to another pit box 112, for example as individuals racers enter and leave the pit road 104 to obtain close-up video and/or audio of the pit stop. The safety barrier 120 and safety lane 122 also provide a protected avenue for movement, for example for safety personnel and/or officials that may not normally occupy each individual pit box 112 during a racing event. In this embodiment, the safety barriers 120 and safety lane 122 are interposed between the adjacent pit boxes 112 and the pit road entrance 106. It will be understood however that this is simply illustrative of one embodiment and in other embodiments, safety barriers 120 and an associated safety lane 122 can be arranged adjacent an opposite pit road exit 110. In yet other embodiments, safety barriers 120 and safety lanes 122 can be provided on both sides of a pit road 104.

Figure 5:
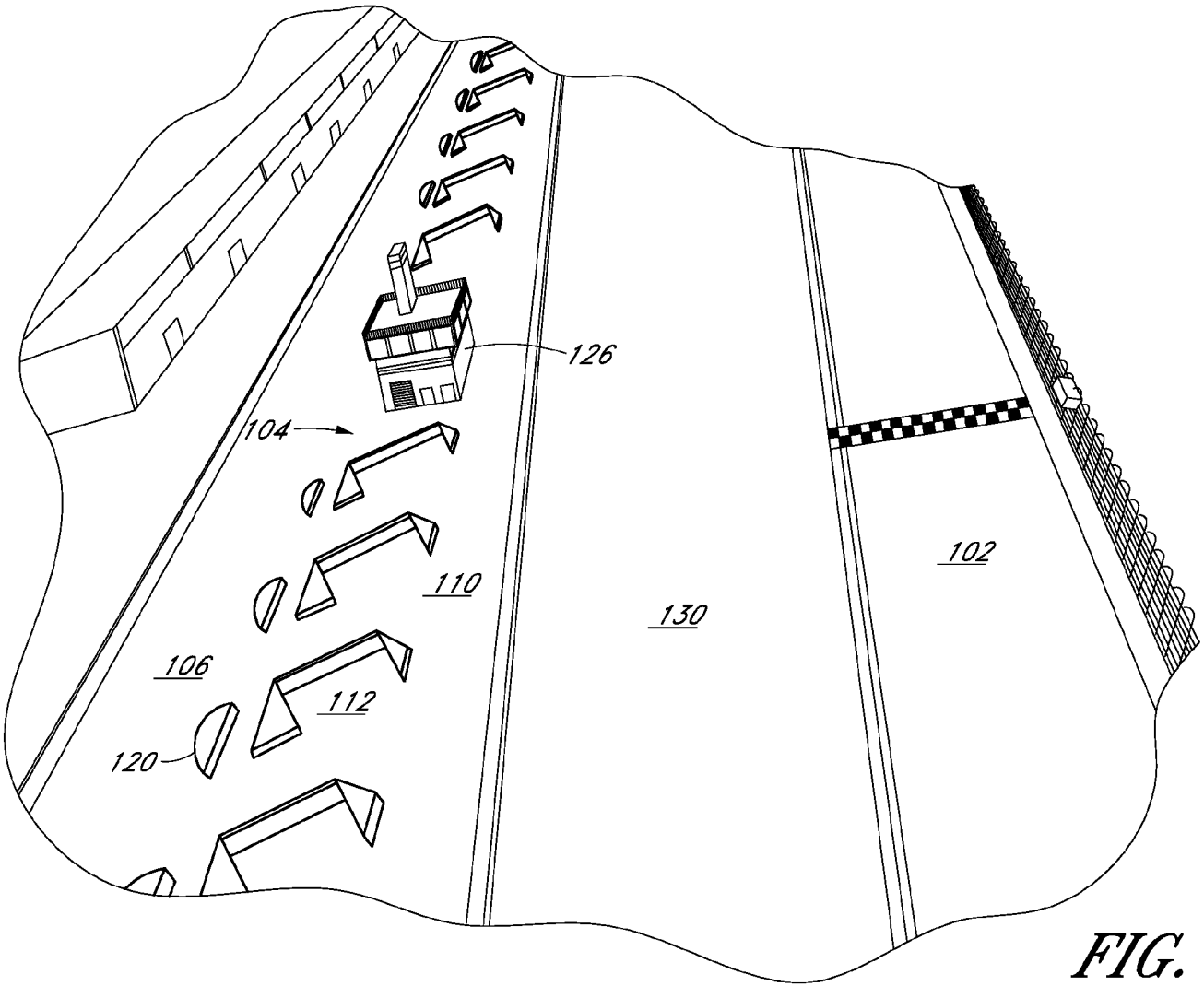
FIG. 5 is a perspective view of a racetrack and pit road illustrating embodiments of relationships between a pit road and a racing surface.

FIG. 5 illustrates a further perspective view of an embodiment of racetrack 100 including a racing surface 102 and pit road 104. In this embodiment, the racetrack 100 includes one or more towers 126 that can be arranged within or adjacent the pit road 104. The towers 126 can provide an elevated structure, for example for improved media visibility and officiating. In this embodiment, the racetrack 100 further comprises an apron 130 interposed between the racing surface 102 and the pit road 104. An apron 130, where present, can be paved or unpaved.

In this embodiment, a plurality of safety barriers 120 is provided with a given safety barrier 120 associated with a respective pit box 112. In this embodiment, the safety barriers 120 are provided with a number or other designator to indicate the respective pit box 112. In this embodiment, a given racer or team would be assigned a respective pit box 112. The markings or designations associated with the safety barrier 120 would provide a visual indication to the racer of the location of their respective pit box 112. While in the illustration of FIG. 5 the safety barriers 120 are provided with numbers, it will be understood that this is simply one embodiment and in other embodiments other designators, such as distinctive colors, patterns, names, and the like can be utilized to designate particular pit boxes 112. It will be further understood that while illustrated as associated with the safety barriers 120, this is also simply one embodiment and in other embodiments individual designators can be associated with one or both of the first and second pit wall supports 116, 118. The fixed designators associated with the pit road 104 reduce the need for crew members to present a flag or banner to an incoming racer, further reducing the likelihood of collisions.

Figure 6A:
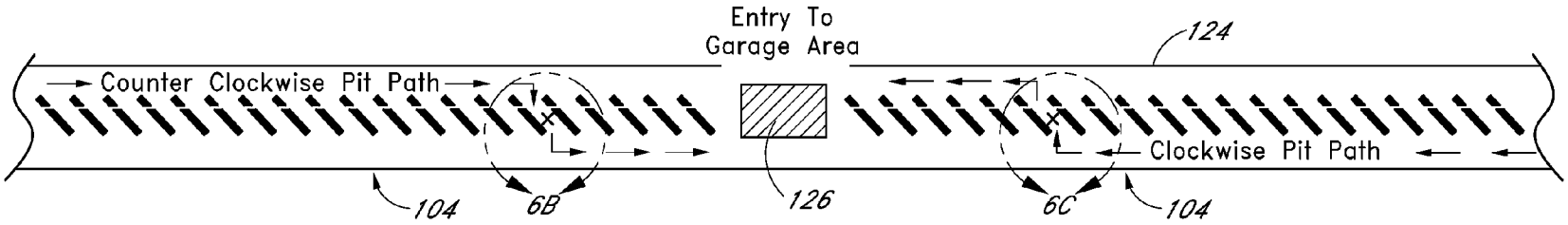
FIG. 6 and Details 1 and 2 thereof are schematic plan views of additional embodiments of a racetrack and pit road.
Figure 6B:
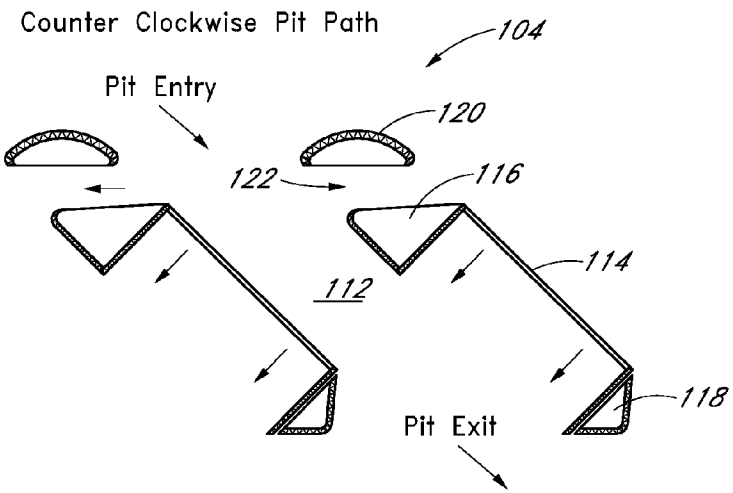
Figure 6C:
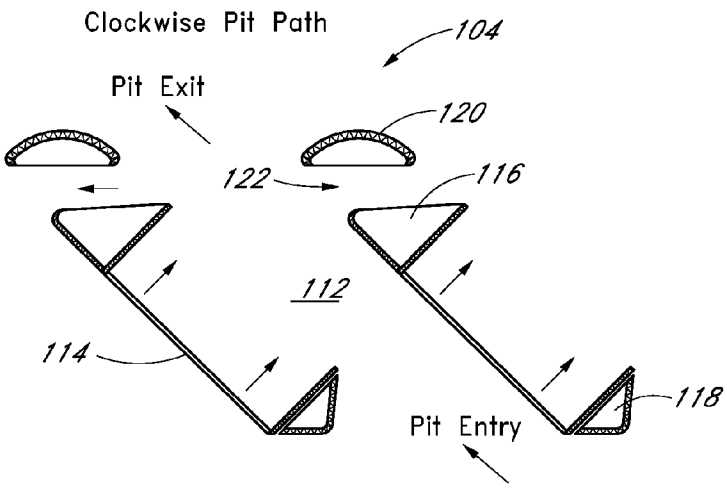

FIG. 6 illustrates schematically a plan view of embodiments of a racetrack 100 and a pit road 104 thereof. As illustrated in FIG. 6, the pit road 104 can be configured for both a clockwise and a counter clockwise direction of traffic. Detail 1 illustrates a counter clockwise path through the pit road 104, e.g. with traffic entering generally at the top in the illustration and exiting at the bottom. Detail 2 illustrates schematically the converse or a clockwise path of traffic through the pit road 104. For example, Detail 2 illustrates that traffic enters generally at the bottom of the illustration and exits at the top. Details 1 and 2 also illustrate that safety barriers 120 and an associated safety lane 122 can be arranged adjacent an entry of the pit road 104 as well as adjacent an exit of the pit road 104.

Figure 7A:
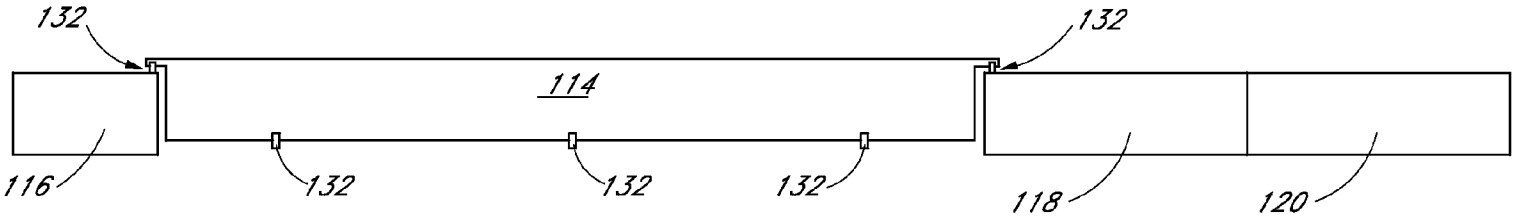
FIG. 7 illustrates side and top views of embodiments of a moveable pit wall of a pit road.
Figure 7B:
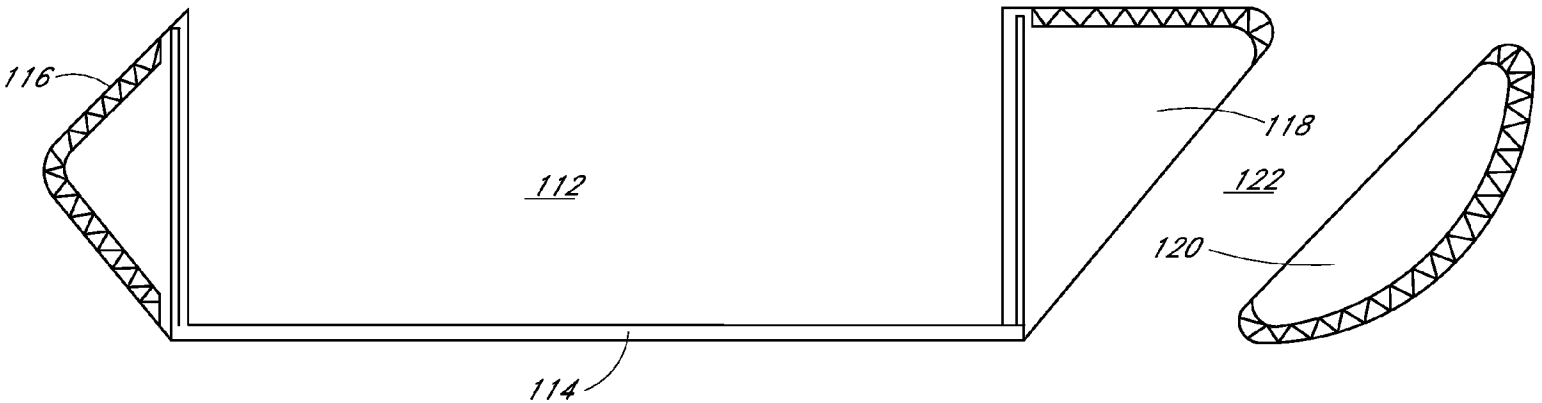

FIG. 7 illustrates a schematic side and top section view of embodiments of a moveable pit wall 114, first and second pit wall supports 116, 118, and safety barriers 120. In this embodiment, the moveable pit wall 114 comprises a generally rigid elongate structure sized appropriately to define a desired dimension of pit box 112. A length of the moveable pit wall 114 will, in some embodiments, be generally on the order of several meters and a height of the moveable pit wall 114 will, in some embodiments, be on the order of one meter.

The first and second pit wall supports 116, 118 can be constructed for substantially permanent emplacement at the racetrack 100. In other embodiments, the first and second pit wall supports 116, 118 can be portable, however can include provision for attachment and securing at a desired location. The first and second pit wall supports 116, 118 can be formed of a wide variety of materials, including but not limited to plastics, concrete, metal, composite materials, and the like. The first and second pit wall supports 116, 118 can comprise hollow structures or can comprise substantially solid structures. One or more surfaces of the first and second pit wall supports 116, 118 can be provided with resilient or soft outer surfaces. The first and second pit wall supports 116, 118 can be provided with energy absorbing materials that can be of a multi-use construction or of a single use construction. In some embodiments, the first and second pit wall supports 116, 118 can define a generally triangular profile in plan section views. However, a wide variety of shapes and contours of the first and second pit wall supports 116, 118 are possible including but not limited to circular, square, non-square rectangular, oblong, and others. Construction and composition of the safety barriers 120, where present, can be substantially similar to that previously described for the first and second pit wall supports 116, 118.

In some embodiments, the moveable pit wall 114 comprises one or more rollers 132 to facilitate movement of the moveable pit wall 114 with respect to the first and second pit wall supports 116, 118. In some embodiments, the moveable pit all 114 can also comprise rollers 132 arranged generally along a lower edge of the moveable pit wall 114, for example to facilitate rolling movement with respect to a surface upon which the moveable pit wall 114 rests. As previously noted, a desirable aspect of at least certain embodiments it that the moveable pit wall 114 can be moved in a generally sideways or transverse direction. This allows a race organizer and/or racing team to orient the moveable pit walls 114 to a desired location. For example, for certain racing events it may be desirable to have the associated pit boxes 112 arranged to the right of the moveable pit wall 114 whereas for other racing events it may be desirable to have the associated pit box 112 arranged to the left of the associated moveable pit wall 114. By providing a moveable pit wall 114 and first and second pit wall supports 116, 118 that can be portable and secured in position, the pit road 104 provides a wide variety of customizable configurations to accommodate the needs of a wide variety of racing venues. The pit road 104 further provides the advantage of adjustability, for example to accommodate the needs of different racing events that may occur at a given racetrack 100.

Figure 8:
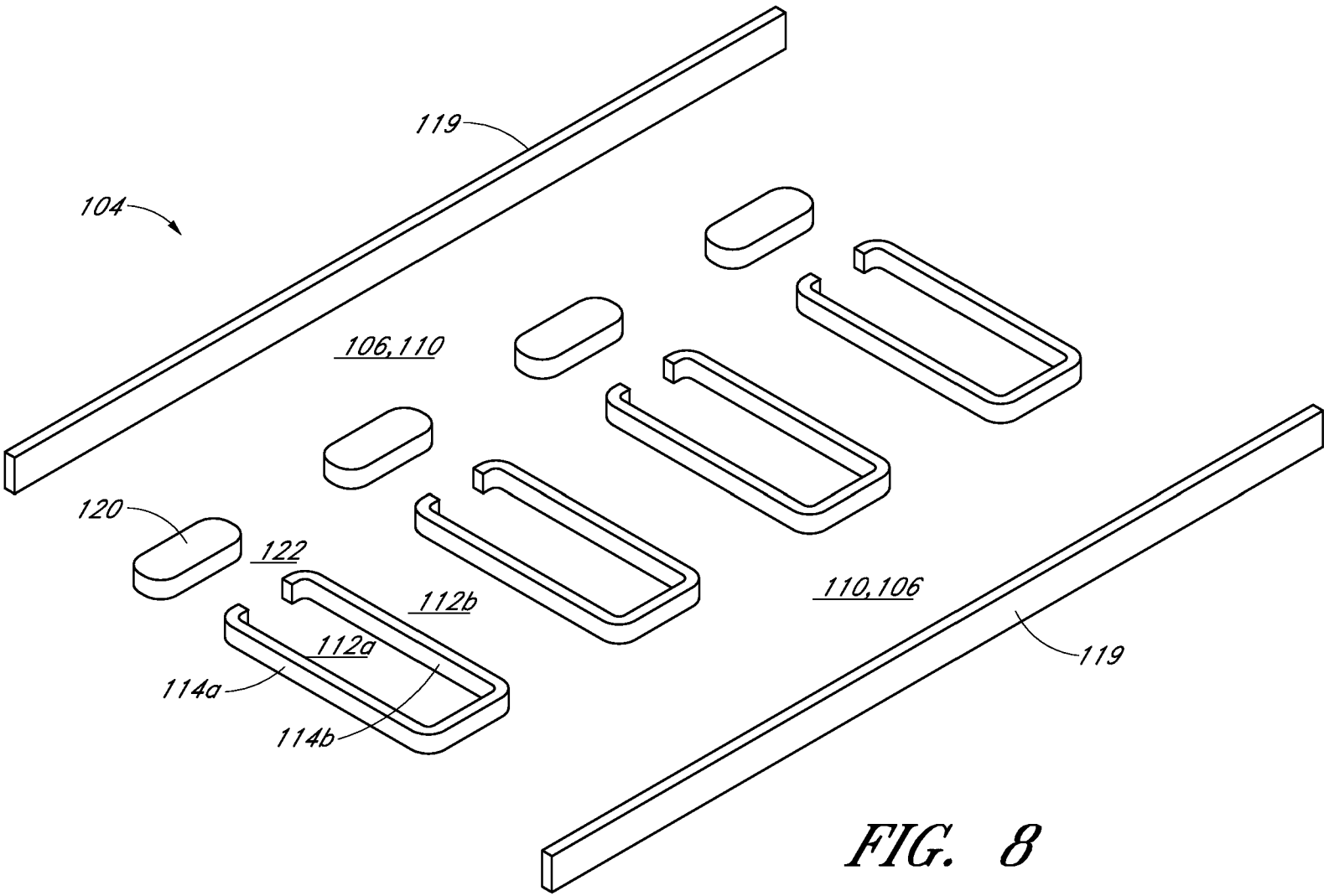
FIG. 8 illustrates additional embodiments of a racetrack and pit road.

FIG. 8 illustrates schematically a perspective view of a further embodiment of pit road 104. This embodiment shares certain similarities with the embodiments of pit road 104 previously described, however this embodiment includes a pair of pit walls 114*a* and 114*b* associated with a respective pit box 112. In this embodiment, the pair of pit walls 114*a*, 114*b* substantially encloses and define a crew space 112*a* with an entrance/exit adjacent a safety lane 122. The crew space 112*a* is adjacent the service area 112*b* and is partitioned therefrom by the pit wall 114*b*. This embodiment provides additional barriers and isolation between a crew area 112*a* to further inhibit collisions between personnel and equipment within the crew area 112*a* and any passing vehicles.

Although the preferred embodiments of the present invention have shown, described and pointed out the fundamental novel features of the invention as applied to those embodiments, it will be understood that various omissions, substitutions and changes in the form of the detail of the device illustrated may be made by those skilled in the art without departing from the spirit of the present invention. Consequently, the scope of the invention should not be limited to the foregoing description but is to be defined by the appended claims.

What is claimed is:

1. A racing facility for racing automobiles comprising:

a racing surface;

a pit road having a pit road entrance and a pit road exit disposed at opposing ends of the pit road, said pit road entrance and pit road exit are connected to the racing surface and intersect the racing surface at acute angles so as to provide a smooth transition for the automobiles entering and exiting the pit road;

a plurality of pit walls and pit wall supports disposed on the pit road and defining a plurality of elongate pit boxes arranged in a side by side configuration and at an angle with respect to the pit road entrance and wherein each pit wall is movable in a generally transverse manner with respect to the respective pit wall supports such that a given pit box can be defined on a left side or on a right side of a respective pit wall; and wherein at least a portion of the pit road exit is arranged substantially parallel to at least a portion of the pit road entrance.

2. The racing facility of claim 1, wherein the racing surface defines a closed loop and wherein the pit road entrance, pit boxes, and pit road exit are arranged in an interior of the racing facility.

3. The racing facility of claim 1, wherein the pit road entrance and the pit road exit are arranged substantially parallel to an adjacent portion of the racing surface.

4. The racing facility of claim 1, wherein the plurality of pit wall supports is portable.

5. The racing facility of claim 1, further comprising a plurality of safety barriers arranged to define at least one safety lane and wherein the safety barriers provide a physical barrier between the at least one safety lane and the pit road entrance and exit.

6. The racing facility of claim 1, wherein at least a portion of the pit road is adjacent a portion of the racing surface.

7. The racing facility of claim 1, further comprising fixed designators indicating the location of designated pit boxes.

8. The racing facility of claim 1, wherein at least one of the pit road entrance and the pit road exit intersect the racing surface at an acute angles of approximately 45° or less.

9. The racing facility of claim 1, further comprising a pair of pit walls associated with a respective pit box and wherein the pair of pit walls define a crew area of the pit box and a service area of the pit box wherein one of the pair of pit walls forms a partition between the crew area and the service area.

10. A pit road for a racing facility, the pit road comprising:

a pit road entrance configured to intersect a racing surface of a racing facility;

a pit road exit configured to intersect the racing surface of the racing facility; and a plurality of pit stops arranged between the pit road entrance and the pit road exits, wherein each pit stop has an entrance area and an exit area that are located on opposing ends of the pit stop, said pit stops are arranged in a side by side configuration such that cars entering the entrance areas of the pit stops do not intersect with cars exiting the exit areas of pit stops, wherein each pit stop comprises a pit wall and a plurality of pit wall supports, said pit wall supports are portable and arranged at opposite ends of the pit wall and engaged with the pit wall in a manner such that the pit wall is movable in transverse direction with respect to the pit wall supports.

11. The pit road of claim 10, further comprising a plurality of safety barriers arranged to define at least one safety lane so as to provide a physical barrier between the at least one safety lane and an entrance or an exit from the pit road.

12. The pit road of claim 10, wherein the movable pit walls comprise one or more rollers to support rolling movement of the movable pit walls.

13. The pit road of claim 10, further comprising a pair of pit walls associated with a respective pit box and wherein the pair of pit walls define a crew area of the pit stop and a service area of the pit stop wherein one of the pair of pit walls forms a partition between the crew area and the service area.

* * * * *